US011447333B2

(12) United States Patent
Kuhl et al.

(10) Patent No.: US 11,447,333 B2
(45) Date of Patent: Sep. 20, 2022

(54) TRASH BAG RETAINING APPARATUS

(71) Applicant: THE CLOROX COMPANY, Oakland, CA (US)

(72) Inventors: Sarah A. Kuhl, Willowbrook, IL (US); Timothy P. Mui, Pleasanton, CA (US); Reema Shalan, Cupertino, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 17/118,830

(22) Filed: Dec. 11, 2020

(65) Prior Publication Data

US 2021/0198036 A1 Jul. 1, 2021

Related U.S. Application Data

(60) Provisional application No. 62/954,122, filed on Dec. 27, 2019.

(51) Int. Cl.

| | |
|---|---|
| ***B65F 1/00*** | (2006.01) |
| ***B65F 1/14*** | (2006.01) |
| ***B65F 1/06*** | (2006.01) |

(52) U.S. Cl.

CPC ..... *B65F 1/1415* (2013.01); *B65F 1/062* (2013.01); *B65F 1/067* (2013.01); *B65F 2210/18* (2013.01)

(58) Field of Classification Search

None

See application file for complete search history.

(56) References Cited

U.S. PATENT DOCUMENTS

| | | | | |
|---|---|---|---|---|
| 4,762,297 | A | 8/1988 | Milligan | |
| 4,819,898 | A | 4/1989 | Benoit et al. | |
| 4,881,706 | A | 11/1989 | Sedlik | |
| 4,984,759 | A | 1/1991 | Perlant | |
| 4,998,694 | A * | 3/1991 | Barteaux | B65B 67/1216 248/100 |
| 5,005,791 | A | 4/1991 | Lanzen | |
| 5,020,750 | A | 6/1991 | Vrooman et al. | |
| 5,335,788 | A | 8/1994 | Beasley et al. | |
| 5,803,299 | A | 9/1998 | Sealy, Jr. | |
| 6,042,063 | A | 3/2000 | Kerr et al. | |

(Continued)

FOREIGN PATENT DOCUMENTS

| | | | |
|---|---|---|---|
| GB | 2299066 | A | 3/1995 |
| JP | 2009143598 | A | 7/2009 |

(Continued)

*Primary Examiner* — Steven M Marsh

(74) *Attorney, Agent, or Firm* — Workman Nydegger

(57) ABSTRACT

The present disclosure relates to a trash bag retaining apparatus and system that secures a trash bag inside a trash receptacle and enables a sliding motion for subsequent removal of the secured trash bag. In particular, the apparatus includes a proximal end insertable into a support arm of a trash receptacle. The distal end includes a slide stop in addition to an abutment face that abuts the support arm upon insertion of the proximal end into the support arm. The abutment face is sized and shaped to match a size and shape of the support arm. Further, the distal end also includes one or more surfaces defining an inlet, positioned between the slide stop and the abutment face, where the trash bag retaining apparatus can secure a portion of the trash bag to the support arm.

20 Claims, 6 Drawing Sheets

(56) References Cited

U.S. PATENT DOCUMENTS

| | | | | |
|---|---|---|---|---|
| 6,098,933 | A | 8/2000 | Stein | |
| 6,152,408 | A * | 11/2000 | O'Grady | B65B 67/1227 248/100 |
| 6,352,225 | B1 | 3/2002 | Dooley et al. | |
| 6,726,156 | B1 * | 4/2004 | Scola | B65B 67/1227 248/100 |
| D770,783 | S * | 11/2016 | Stroud | D6/327 |
| 2010/0001004 | A1 | 1/2010 | Slot | |
| 2010/0123050 | A1 * | 5/2010 | Astwood | B65B 67/1227 248/100 |
| 2010/0123051 | A1 * | 5/2010 | Astwood | B65B 67/1205 248/100 |
| 2012/0006777 | A1 * | 1/2012 | Schiller | F16B 47/00 211/85.15 |
| 2015/0049961 | A1 | 2/2015 | Castro | |
| 2015/0053709 | A1 | 2/2015 | Dennison et al. | |
| 2016/0001973 | A1 | 1/2016 | Castro | |
| 2016/0304276 | A1 | 10/2016 | Castro | |

FOREIGN PATENT DOCUMENTS

| | | | |
|---|---|---|---|
| KR | 200182651 | Y1 | 5/2000 |
| KR | 100462463 | B1 | 11/2003 |
| KR | 200388738 | A | 11/2003 |
| KR | 200383991 | A | 5/2005 |
| KR | 20110129700 | A | 5/2010 |
| KR | 1020140136835 | A | 12/2014 |
| KR | 101484546 | B1 | 1/2015 |
| WO | 2009141620 | A1 | 11/2009 |

* cited by examiner

TRASH BAG RETAINING APPARATUS

CROSS-REFERENCE

This application claims the benefit of and priority to U.S. Provisional Application No. 62/954,122, filed on Dec. 27, 2019. The disclosure is herein incorporated by reference in its entirety.

BACKGROUND

Fast food employees, hospital workers, amusement park workers, flight attendants, janitorial staff, and many other service-type workers spend a great deal of time and effort on changing trash bags. For example, service workers typically clean in and/or around a trash receptacle where garbage falls outside of the trash bag, due at least in part to improper securing of the trash bag within the trash receptacle. As another example, service workers replace used trash bags with new trash bags. Often, replacing used trash bags involves various time consuming and tedious tasks such as lifting of the used trash bag, untying/tying of one or more trash bags, and dealing with onerous retaining mechanisms/designs of conventional trash bag retaining systems.

Such difficulties as just described stem from one or more example problems of conventional trash bag retaining systems (hereafter "conventional systems"). For example, some conventional systems that employ a rail system within a trash receptacle, as opposed to a garbage can-and-liner system, fail to adequately secure a leading edge of a trash bag within the trash receptacle. This problem is two-fold. First, the leading edge of the trash bag can simply fall into the trash receptacle, leading to a preventable mess of uncollected garbage. Second, the trash bag can creep (i.e., incrementally return) to a closed position when garbage is tossed into the trash bag until the trash bag fails to collect garbage when disposed into the trash receptacle. Thus, conventional systems fail to adequately and conveniently secure the leading edge of a trash bag.

As another example problem, conventional systems do not facilitate easy removal of trash bags, in particular used trash bags full of garbage. For instance, conventional systems that employ a rail system within a trash receptacle, as opposed to a garbage can-and-liner system, often employ various features along the rails in an attempt to prevent the trash bag from slipping off the rails or closing up as described above. These conventional features can include, for example, protruding hooks, deep recesses, grooves, bumps, curvature, etc. Thus, to remove a trash bag that hangs from such a rail with these features, a user typically employs a lifting motion when removing the trash bag to traverse these features or else risk snagging or tearing the trash bag. This removal process is both arduous and time consuming, and moreover can still result in snagging or tearing of the trash bag despite trying to avoid the features of the rails.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY

Aspects of the present disclosure relate to a trash bag retaining apparatus and system that secures a trash bag inside a trash receptacle and conveniently enables a sliding motion for subsequent removal of the secured trash bag. In particular, the apparatus includes a distal end having an inlet and a slide stop. The trash bag retaining apparatus has a uniform size and shape, which uniformity helps to facilitate the above-mentioned sliding motion. Further, the distal end also includes one or more surfaces defining the inlet, positioned between the slide stop and a proximal end, where the trash bag retaining apparatus can secure a portion of the trash bag to a support arm (when the support arm is a separate component from the trash bag retaining apparatus) or a trash receptacle (when the trash bag retaining apparatus is part of the support arm).

Additional features and advantages of one or more embodiments of the present disclosure are outlined in the following description.

BRIEF DESCRIPTION OF THE DRAWINGS

The detailed description provides one or more embodiments with additional specificity and detail through the use of the accompanying drawings, as briefly described below.

DETAILED DESCRIPTION

Figure 1A:
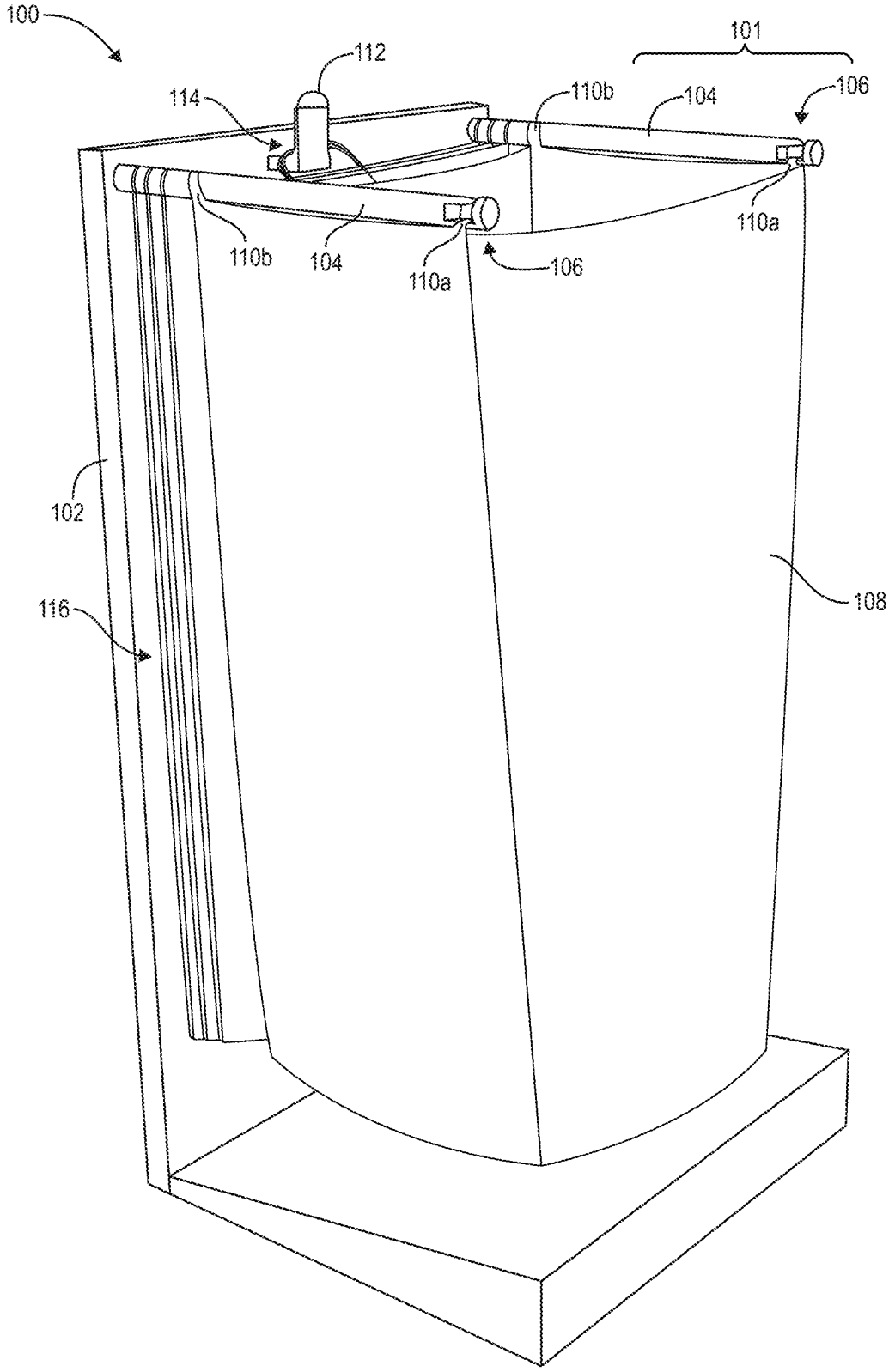
FIGS. 1A-1C illustrate the trash bag retaining apparatus in use in accordance with one or more embodiments.

This disclosure describes one or more embodiments of a trash bag retaining apparatus that secures a trash bag inside a receptacle and subsequently allows for easy removal of the trash bag. In particular, the trash bag retaining apparatus includes a hook-and-catch mechanism as part of a pair of support arms from which trash bags can hang. The hook-and-catch mechanism secures a leading edge of the trash bag by preventing the leading edge from slipping off a support arm. In addition, the hook-and-catch mechanism maintains the trash bag in an open position by keeping the leading edge from sliding backwards along the support arm towards the trailing edge of the trash bag (i.e., returning towards a closed position).

To illustrate, the hook-and-catch mechanism includes a distal end that comprises a slide stop, an abutment face, and one or more surfaces defining an inlet positioned between the slide stop and a proximal end. The inlet can extend into the body of the trash bag retaining apparatus and can be sized and configured to catch and retain a leading edge of a trash bag. The slide stop prevents the leading edge of the trash bag from slipping out of the inlet and off the support arm by partially bounding the inlet designed to catch and hold the trash bag in place.

As just mentioned, the trash bag retaining apparatus utilizes uniformity of size and shape. For example, the trash bag retaining apparatus and the support arm have a uniform profile shape (e.g., a circular cross section). In particular, the trash bag retaining apparatus of uniform size and shape enables a leading edge of the trash bag to easily slide along the support arm and into the inlet without traversing various features of conventional systems. Once the inlet captures the leading edge of the trash bag, a user can remove the leading edge from within the inlet by utilizing a pulling motion. A user can continue this pulling motion for removal of the trash bag, and the trash bag retaining apparatus of uniform size and shape allows the trailing edge of the trash bag to easily slide along the support arm (void of features to traverse) and then pass over (i.e., bypass) the inlet.

As suggested by the foregoing, the trash bag retaining apparatus can provide several technical advantages relative to conventional systems. For example, the inlet of the trash bag retaining apparatus can easily catch a leading edge of a trash bag to prevent the trash bag from falling off. Additionally, the inlet of the trash bag retaining apparatus, unlike conventional systems, holds a position of the leading edge of the trash bag such that the trash bag does not return to a closed position upon receiving tossed garbage. In turn, the trash bag retaining apparatus lends to cleaner areas in and/or around a trash receptacle due to the trash bag retaining apparatus maintaining a proper position of the trash bag within the trash receptacle.

Furthermore, the trash bag retaining apparatus enables a sliding removal without lifting the trash bag for quick and easy removal. In particular, the uniform size and shape of the trash bag retaining apparatus allows the trash bag to slide, in response to a pulling motion, across the support arm without need to traverse various features of conventional systems. Indeed, the sliding surface of the trash bag retaining apparatus is smooth and non-inhibiting. In accordance with this design, the inlet of the trash bag retaining apparatus is positioned underneath the sliding surface for conveniently avoiding when removing the trash bag. In this manner, the trash bag retaining apparatus does not include features on the sliding surface that would otherwise impede the pulling motion for easily removing the trash bag off the support arm. Additionally, the inlet of the trash bag retaining apparatus is sufficiently shallow such that the above-mentioned pulling motion easily causes the leading edge of the trash bag to escape the inlet during removal of the trash bag.

As illustrated by the foregoing discussion, the present disclosure utilizes a variety of terms to describe features and benefits of the trash bag retaining apparatus. Additional detail is now provided regarding the meaning of these terms. For example, as used herein, the term "support arm" refers to a member of a trash receptacle or canister. In particular, the support arm can include a rail of a variety of sorts upon which a trash bag can hang thereon (e.g., in an open position for receiving garbage and/or a closed position as an extra/unused trash bag). For example, the support arm can include a shaft, rod, or other suitable member that can easily engage (e.g., due to uniform dimensions without protrusions, recesses, etc.) a trash bag sliding across an outer surface of the support arm. Further, a pair of support arms is cantilevered at a receptacle wall (e.g., a physical divider at least partially bounding the trash receptacle) from which the pair of support arms extend outward for supporting trash bags hanging therefrom.

As further used herein, the term "proximal end" refers to an end portion of the trash bag retaining apparatus. In particular, the proximal end can include an end portion of the trash bag retaining apparatus that is integrated with the support arm, wherein "proximal" is from the perspective of the receptacle wall at which the pair of support arms is cantilevered. For example, integration of the proximal end with the support arm can include a manufacturable integration where the trash bag retaining apparatus is formed into or otherwise affixed to the support arm, thereby forming a single component. In other embodiments, integration of the proximal end with the support arm can include a post-manufacturing integration (e.g., via user assembly) where the trash bag retaining apparatus as a separate, distinct component from the support arm can be inserted into or over the support arm.

Relatedly, as used herein, the term "distal end" refers to another end portion of the trash bag retaining apparatus. In particular, the distal end can include an end portion of the trash bag retaining apparatus that is configured for securing a trash bag in an open position, wherein "distal" is from the perspective of the receptacle wall at which the pair of support arms is cantilevered. Accordingly, from the perspective of the receptacle wall at which the pair of support arms is cantilevered, the distal end of the trash bag retaining apparatus is positioned farther away from the receptacle wall when the proximal end is inserted into or otherwise integral to the support arm.

As also used herein, the term "sliding surface" refers to a surface that engages a trash bag. In particular, the sliding surface can include a portion of the support arm that interfaces with a portion of the trash bag as the trash bag proceeds towards and/or away from the receptacle wall at which the pair of support arms is cantilevered. For example, the sliding surface may include a flat surface, a rounded surface, an inclined surface, etc. (without protrusions or recesses) that facilitates a sliding motion of the trash bag along the support arm.

As additionally used herein, the term "inlet" refers to a cavity for receiving a portion of a trash bag. In particular, the inlet is defined by one or more surfaces designed to (i) catch and receive a leading edge of a trash bag for securing the trash bag in the open position; (ii) enable a quick release of the secured leading edge of the trash bag with a pulling motion (not a lifting motion); and (iii) not catch the trailing edge of the trash bag during replacement of the trash bag. For example, one or more surfaces of the inlet comprises an overhang portion (e.g., a surface that juts outward and hangs over other portions of the inlet) from the sliding surface positioned above the inlet.

As further used herein, the term "slide stop" refers to a hook portion of the trash bag retaining apparatus. In particular, the slide stop helps to prevent the leading edge of the trash bag from slipping off the support arm when securing the trash bag in place (i.e., when securing the leading edge of the trash bag inside the inlet).

Additionally, as used herein, the term "abutment face" refers to a surface configured to contact the support arm. In particular, the abutment face contacts the support arm when the proximal end is inserted into the support arm. For example, the abutment face is sized and shaped (e.g., dimensioned perimeter-wise) the same as the support arm to create a uniform sliding surface such that the trash bag encounters no hooks, snags, protrusions, recesses, etc. when sliding past the abutment face.

As used herein, the term "trash bag" refers to a sack for waste collection. In particular, the trash bag includes eyelets for hanging and sliding on the pair of support arms. Additional features may also form part of the trash bag (e.g., to increase a payload capacity of the trash bag, inhibit tearing, prevent leakage, maintain an optimal form, etc.).

Additional detail will now be provided regarding the trash bag retaining apparatus in relation to illustrative figures portraying example embodiments and implementations of the trash bag retaining apparatus. For example, FIGS.

Figure 1B:
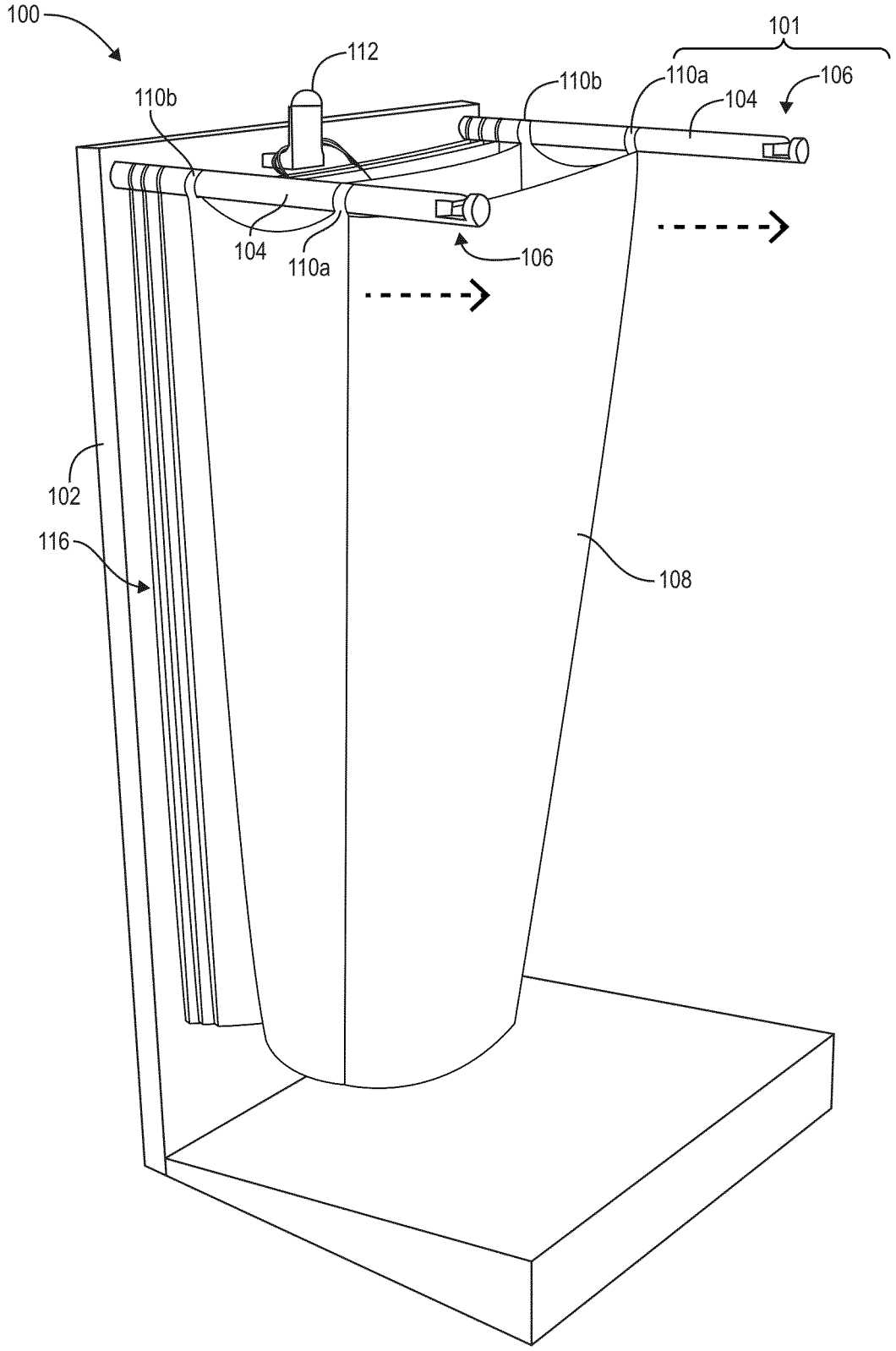
Figure 1C:
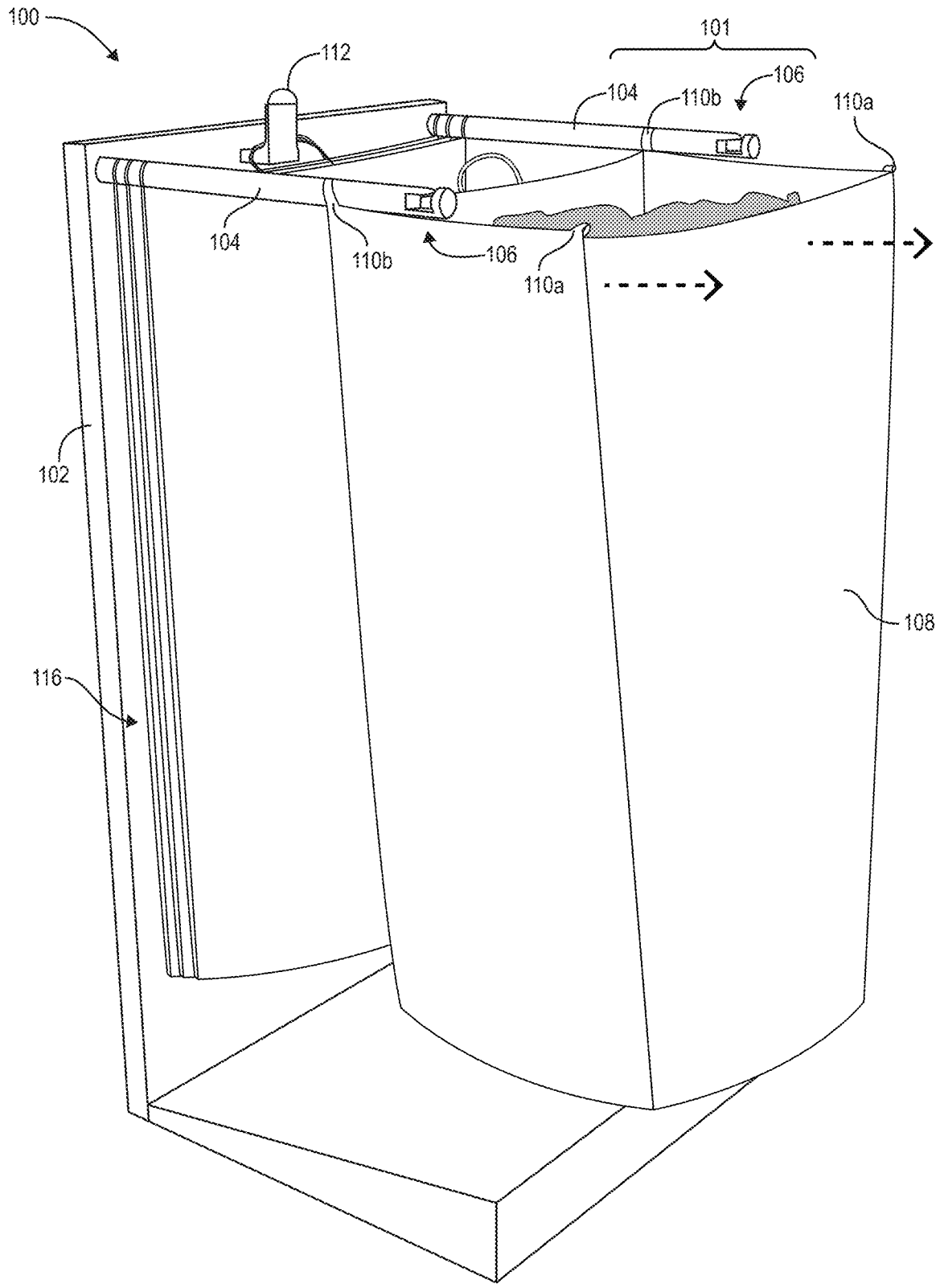

1A-1C illustrate an environment 100 in which a trash bag retaining apparatus 101 can operate in accordance with one or more embodiments. In particular, FIG. 1A illustrates a trash bag 108 secured by the trash bag retaining apparatus 101 in an open position; FIG. 1B illustrates the trash bag 108 sliding towards an open position from a closed position; and FIG. 1C illustrates the trash bag 108 being slidably removed over the trash bag retaining apparatus 101.

As shown in FIG. 1A, the trash bag retaining apparatus 101 includes a pair of support arms 104 and a pair of hook-and-catch mechanisms 106 (e.g., integrated together by way of manufacture). Thus, in some embodiments, a trash bag retaining apparatus 101 as disclosed herein can include a support arm 104 and a hook-and-catch mechanism 106 formed together or otherwise manufactured as a single component (e.g., as shown in FIGS. 1A-1C). In other embodiments, however, the trash bag retaining apparatus 101 can include just the hook-and-catch mechanism 106 alone. For instance, according to embodiments described below in relation to FIGS. 2A-4, the hook-and-catch mechanism 106 is a distinct component for inserting into the support arm 104, or alternatively, for fitting over at least a portion of the support arm 104.

In more detail, FIG. 1A illustrates the environment 100 as including the trash bag retaining apparatus 101 along with a receptacle wall 102, a trash bag 108, and extra trash bags 116. The receptacle wall 102 provides support for or otherwise anchors the support arms 104 in a fixed position. For example, the support arms 104 can attach to the receptacle wall 102 in a cantilevered manner, thereby fixing the support arms 104 into place within a trash receptacle. Additionally, the receptacle wall 102 can help suspend the trash bag 108 and the extra trash bags 116, while also positionally maintaining a back portion of the trash bag 108 and the extra trash bags 116 at or near the receptacle wall 102. For instance, the receptacle wall 102 includes an anchor 112, which the trash bag 108 and the extra trash bags 116 hook onto via respective loops 114 connected to each trailing edge of the trash bag 108 and the extra trash bags 116.

Further, with the structural support from the receptacle wall 102, the support arms 104 suspend the trash bag 108 and the extra trash bags 116 via leading edge eyelets 110*a* and trailing edge eyelets 110*b* of the trash bags. Moreover, the support arms 104 enable the leading edge eyelets 110*a* and the trailing edge eyelets 110*b* to easily slide along sliding surfaces of the support arms 104. For example, the leading edge eyelets 110*a* of the trash bag 108 can slide along the sliding surfaces of the support arms 104 until secured within the hook-and-catch mechanisms 106. In this manner, the trash bag retaining apparatus 101 prevents the trash bag 108 from falling off the support arms 104 while also holding a position of the leading edge eyelets 110*a* such that the trash bag 108 does not return to a closed position upon receiving tossed garbage.

FIG. 1B illustrates the same elements as FIG. 1A, but further illustrates the above-mentioned sliding of the leading edge eyelets 110*a* as indicated by the dashed arrows. In particular, FIG. 1B illustrates the leading edge eyelets 110*a* of the trash bag 108 sliding on the support arms 104 from a closed position towards an open position when secured in the hook-and-catch mechanism 106. For example, to achieve the open position of the trash bag 108 as shown in FIG. 1A, a user may pull the trash bag 108 in the direction of the dashed arrows shown in FIG. 1B until the hook-and-catch mechanism 106 secures the leading edge eyelets 110*a* (i.e., the leading edge eyelets 110*a* catches in an inlet of the hook-and-catch mechanism 106 described further below in relation to FIGS. 2A-4).

Similarly, FIG. 1C illustrates the same elements as FIGS. 1A-1B, but further illustrates sliding of the leading edge eyelets 110*a* and the trailing edge eyelets 110*b* in a removal process of the trash bag 108 as indicated by the dashed arrows. In particular, FIG. 1C illustrates the leading edge eyelets 110*a* having already passed over the trash bag retaining apparatus 101, in addition to illustrating the trailing edge eyelets 110*b* sliding towards the hook-and-catch mechanism 106. For example, to achieve removal of the trash bag 108 (full of garbage) as shown in FIG. 1C, a user may pull the trash bag 108 in the direction of the dashed arrows. In response to applying the pulling motion to the trash bag 108, the hook-and-catch mechanism 106 can release the leading edge eyelets 110*a*, and the trailing edge eyelets 110*b* can continue to easily slide along the support arms 104 and subsequently bypass the hook-and-catch mechanism 106. In this manner, a user can quickly remove the trash bag 108 without undue hassle.

In some embodiments, though not illustrated in FIG. 1C, removing the trash bag 108 can pull out a next trash bag of the extra trash bags 116. For example, a back portion of the trash bag 108 may be removably attached to a front portion the next trash bag of the extra trash bags 116. Examples of removable attachments include a heat tack adhesive or other suitable form of attachment such that pulling the trash bag 108 in the direction of the dashed arrows transfers the pulling motion to the next trash bag of the extra trash bags 116. Thus, in some embodiments, as the trailing edge eyelets 110*b* of the trash bag 108 bypasses the hook-and-catch mechanism 106 in a removal process, the hook-and-catch mechanism 106 catches the leading edge eyelet of the next trash bag of the extra trash bags 116. In this manner, the trash bag retaining apparatus 101 can facilitate a simultaneous quick removal and replacement of trash bags.

One will appreciate that while FIGS. 1A-1C illustrate a particular configuration of the trash bags, loops 114, and eyelets 110*a*, 110*b*, other configurations are also contemplated. For example, rather than having eyelets, the top of the trash bags 108, 116 can have a hem within which the support arms 104 can be inserted. Similarly, some embodiments can lack the loops and the anchor 112.

Figure 2A:
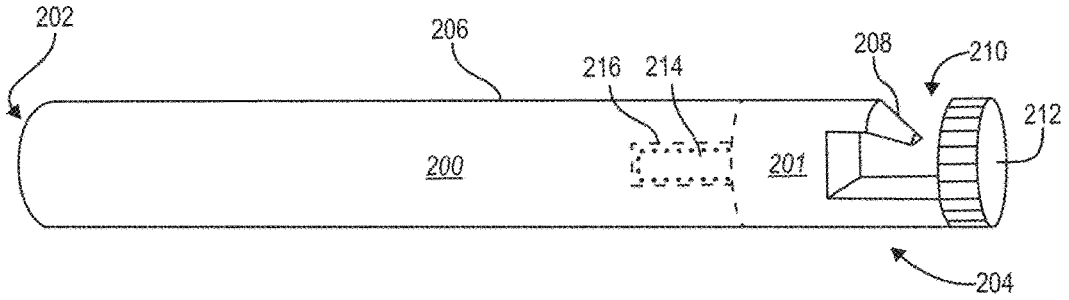
FIG. 2A illustrates an assembly view of a trash bag retaining apparatus in accordance with one or more embodiments.
Figure 2B:
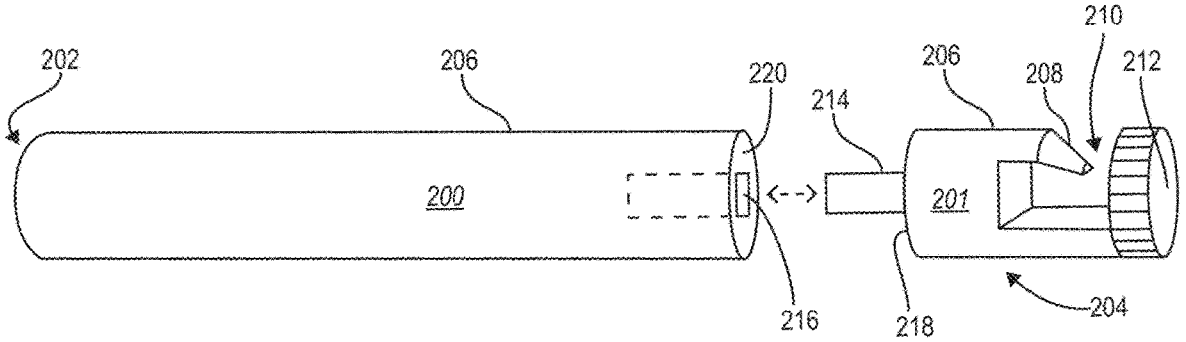
FIG. 2B illustrates an exploded view of a trash bag retaining apparatus in accordance with one or more embodiments.

As mentioned above, the trash bag retaining apparatus can secure a leading edge of a trash bag when the leading edge slides along a sliding surface of a support arm and into a hook-and-catch mechanism. FIGS. 2A-2B illustrate assembly and exploded views, respectively, of a trash bag retaining apparatus 201 relative to a support arm 200 in accordance with one or more embodiments of the present disclosure. The support arm 200 and the trash bag retaining apparatus 201 are the same as or similar to the support arm 104 and the hook-and-catch mechanism 106, respectively, of FIGS. 1A-1C.

As shown, FIG. 2A illustrates the trash bag retaining apparatus 201 inserted into the support arm 200 such that a leading edge of a trash bag can easily slide along the support arm 200 via a sliding surface 206 until secure inside an inlet 210 of the trash bag retaining apparatus 201. In more detail, the sliding surface 206 proceeds from an end 202 of the support arm 200 where secured to a receptacle wall as shown in FIGS. 1A-1C. From the end 202, the sliding surface 206 proceeds along a top portion of the support arm 200, then along a top portion of the trash bag retaining apparatus 201 until the sliding surface 206 becomes an inclined surface 208 extending inward into the inlet 210.

Moreover, the sliding surface 206 is consistent such that a user can easily slide a trash bag without hindrance. Indeed, the support arm 200 maintains a uniform size and shape (e.g., cross-section shape) such that the dimensions of the support arm 200 are constant between the end 202 and an end 220 (shown in FIG. 2B). Further, a size and shape of the trash bag retaining apparatus 201 matches the size and shape of the support arm 200 such that the sliding surface 206 is also consistent between the support arm 200 and the trash bag retaining apparatus 201. Specifically, a size and shape of the abutment face 218 matches a size and shape of the support arm 200. Likewise, a size and shape of the slide stop 212 matches the size and shape of the abutment face 218. This consistency and uniformity of the sliding surface 206 allows a pulling motion to facilitate convenient movement of a trash bag (i.e., no lifting or traversing over features perturbing the sliding surface 206). Thus, to easily secure the trash bag, a user can pull a leading edge of the trash bag along the sliding surface 206 until the inclined surface 208 helps the leading edge of the trash bag drop into the inlet 210 where secure. As shown, the inlet 210 can extend into a body of the trash bag retaining apparatus.

Figure 3A:
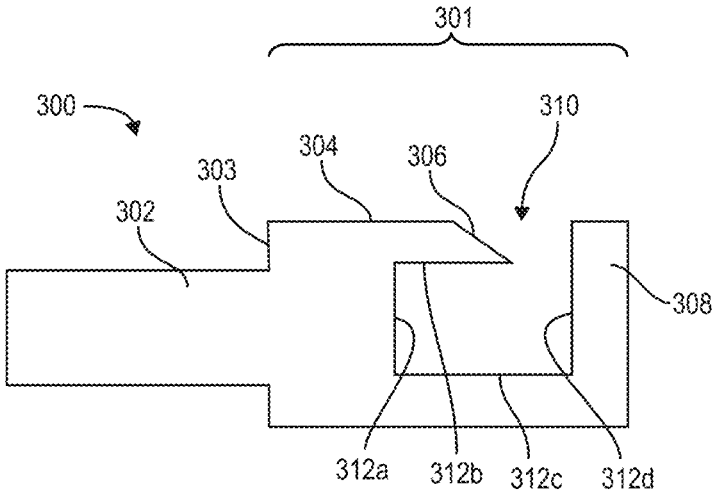
FIG. 3A illustrates a side view of a trash bag retaining apparatus in accordance with one or more embodiments.
Figure 3B:
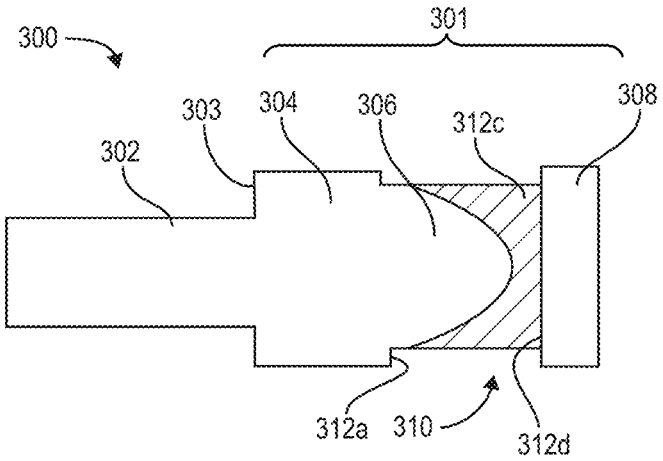
FIG. 3B illustrates a top view of a trash bag retaining apparatus in accordance with one or more embodiments.
Figure 4:
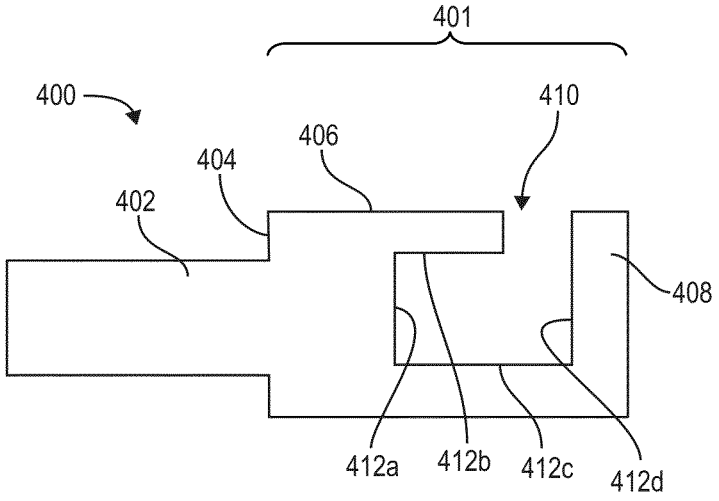
FIG. 4 illustrates a side view of a trash bag retaining apparatus in accordance with one or more embodiments.

The inlet 210 secures the leading edge of a trash bag due to one or more surfaces that define the inlet 210, which are described in more detail in relation to FIGS. 3A-4. In general, however, the inlet 210 prevents the trash bag from slipping off altogether or else closing shut (e.g., the leading edge returning back towards the end 202). That is, the inlet 210 prevents lateral motion of the leading edge, for example, due to a slide stop 212.

FIG. 2A further shows a manner in which a proximal end 214 of the trash bag retaining apparatus 201 connects with the support arm 200. Indeed, a distal end 204 of the trash bag retaining apparatus 201 abuts the support arm 200 such that the proximal end 214 is inserted into an internal portion 216 of the support arm 200. Specifically, and as shown in FIG. 2B, an abutment face 218 of the trash bag retaining apparatus 201 abuts the end 220 of the support arm 200 upon insertion of the proximal end 214 into the internal portion 216. In these or other embodiments, the trash bag retaining apparatus 201 and the support arm 200 can join together in a variety of ways. For example, the proximal end 214 (e.g., an outer surface of the proximal end 214) can engage the internal portion 216 when assembled together by press-fit, a threaded engagement, an adhesive, a fastener, or other suitable means. Additionally or alternatively, the trash bag retaining apparatus 201 and the support arm 200 can join together by bonding the abutment face 218 and the end 220 (e.g., utilizing an adhesive, fastener, or other bonding agent). Thus, upon insertion, the proximal end 214 can be fixed within the internal portion 216 of the support arm 200 such that the abutment face 218 and the end 220 maintain contact therebetween. Alternatively, as described above in relation to the embodiments of FIGS. 1A-1C, the trash bag retaining apparatus 201 can be manufactured as part of the support arm 200 itself without separate assembly.

As mentioned above, the trash bag retaining apparatus can secure a leading edge of a trash bag when the leading edge slides along a sliding surface into an inlet defined by one or more surfaces. FIG. 3A-3B illustrate a side view and top view, respectively, of a trash bag retaining apparatus 300 in accordance with one or more embodiments of the present disclosure. The trash bag retaining apparatus 300 is the same as or similar to the hook-and-catch mechanism 106 and the trash bag retaining apparatus 201 of FIGS. 1A-1C and FIG. 2, respectively.

As shown in FIGS. 3A-3B, the trash bag retaining apparatus 300 comprises a distal end 301 and a proximal end 302. The distal end 301 comprises an abutment face 303, a first sliding surface 304, a second sliding surface 306, a slide stop 308, and an inlet 310 defined by surfaces 312*a*-312*d*. In these or other embodiments, the proximal end 302 is insertable into a support arm as described above in relation to the foregoing figures, while the distal end 301 is configured for interacting with a trash bag.

For example, a leading edge of a trash bag can slide along the first sliding surface 304 and then along the second sliding surface 306 angled inward into the inlet 310. With the second sliding surface 306 angled inward into the inlet 310, the second sliding surface 306 promotes easily securing a leading edge of the trash bag. Once the inlet 310 secures the leading edge of the trash bag, the surfaces 312*a*-312*d* help maintain the leading edge of the trash bag inside the inlet 310. For example, the surfaces 312*a*-312*b* help to prevent the leading edge of the trash bag from returning back towards the proximal end 302 of the trash bag retaining apparatus 300 and subsequently closing. Similarly, surfaces 312*c*-312*d* help to prevent the leading edge of the trash bag from slipping off of a support arm.

As further shown in FIGS. 3A-3B, one or more of the surfaces defining the inlet 310 comprises the slide stop 308 (i.e., the surface 312*d*). In addition, one or more surfaces defining the inlet 310 comprises an overhang portion (i.e., the surface 312*b*) from the first sliding surface 304 and/or the second sliding surface 306 positioned above the inlet 310. Accordingly, the surfaces 312*a*-312*d* define a size and shape of the inlet 310 that form a break in the sliding surface (i.e., the first sliding surface 304 and the second sliding surface 306). In these or other embodiments, the size and shape of the inlet 310 allows the inlet 310 to release the leading edge of a trash bag in response to a lateral force parallel to the proximal end 302 (e.g., a pulling force parallel to the support arms 104 as indicated by dashed arrows in FIGS. 1B-1C). For example, the inlet 310 may be sufficiently shallow such that a substantial lifting force is not required to remove the trash bag as mentioned above in relation to the foregoing figures.

As described above, the trash bag retaining apparatus can secure a leading edge of a trash bag when the leading edge slides along a sliding surface into an inlet defined by one or more surfaces. FIG. 4 illustrates a side view of a trash bag retaining apparatus 400 in accordance with one or more embodiments of the present disclosure. Similar to FIG. 3A, FIG. 4 illustrates the trash bag retaining apparatus 400 comprising a distal end 401 and a proximal end 402. The distal end 401 comprises an abutment face 404, a sliding surface 406, a slide stop 408, and an inlet 410 defined by surfaces 412*a*-412*d*.

However, differently from FIG. 3A, FIG. 4 illustrates the sliding surface 406 leading towards inlet 410 in a manner parallel to the proximal end 402. Though the sliding surface 406 is not angled inward into the inlet 410, the trash bag retaining apparatus 400 can nonetheless perform the foregoing functions as described in relation to the foregoing figures.

Modifications, additions, or omissions may be made to the embodiments illustrated and described in relation to the figures without departing from the scope of the present disclosure. For example, in some embodiments, the trash bag retaining apparatus may include a different size and shape of the support arm, various different angles of the sliding surface extending inward into the inlet, among other different embodiments than may be explicitly illustrated or described.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A trash bag retaining apparatus comprising:

a proximal end; and a distal end comprising:

a slide stop; and one or more surfaces defining an inlet positioned between the slide stop and the proximal end, wherein the inlet extends into a body of the trash bag retaining apparatus and is configured to receive and selectively retain an edge of a trash bag;

wherein the trash bag retaining apparatus comprises a uniform profile shape; and wherein the inlet is sufficiently shallow such that a lateral pulling motion easily causes the edge of the trash bag to escape the inlet during removal of the trash bag from the trash bag retaining apparatus.

2. The trash bag retaining apparatus of claim 1, further comprising a sliding surface between the proximal end and the inlet, the sliding surface including an inclined surface extending inward into the inlet.

3. The trash bag retaining apparatus of claim 2, wherein the one or more surfaces defining the inlet comprises an overhang portion from the sliding surface positioned above the inlet.

4. The trash bag retaining apparatus of claim 1, wherein the distal end of the trash bag retaining apparatus is insertable into the proximal end.

5. The trash bag retaining apparatus of claim 1, wherein the uniform profile shape is circular.

6. The trash bag retaining apparatus of claim 1, wherein the proximal end comprises a support arm configured to be secured to a receptable wall.

7. The trash bag retaining apparatus of claim 1, wherein the inlet is sized and shaped to release a portion of a trash bag in response to a lateral force parallel to the proximal end.

8. A trash bag retaining system comprising:

a pair of support arms extending outward from a receptacle wall, the pair of support arms configured to hold a plurality of trash bags; and a trash bag retaining apparatus integrated with each support arm of the pair of support arms, each trash bag retaining apparatus comprising:

a proximal end; and a distal end comprising:

a slide stop; and one or more surfaces defining an inlet positioned between the slide stop and the proximal end, wherein the inlet extends into a body of the trash bag retaining apparatus and is configured to receive and selectively retain an edge of a trash bag;

wherein the support arms comprise a uniform profile shape; and wherein the inlet is sufficiently shallow such that a lateral pulling motion easily causes the edge of the trash bag to escape the inlet during removal of the trash bag from the trash bag retaining apparatus.

9. The trash bag retaining system of claim 8, wherein the proximal end is insertable into a support arm, the proximal end comprising an abutment face to abut the support arm upon insertion of the proximal end into the support arm, the abutment face sized and shaped to match a size and shape of the support arm.

10. The trash bag retaining system of claim 9, wherein the distal end comprises a sliding surface between the abutment face and the inlet, the sliding surface including an inclined surface extending inward into the inlet.

11. The trash bag retaining system of claim 10, wherein the one or more surfaces defining the inlet comprises an overhang portion from the sliding surface positioned above the inlet.

12. The trash bag retaining system of claim 9, wherein a size and shape of the slide stop matches the size and shape of the abutment face.

13. The trash bag retaining system of claim 9, wherein the proximal end is fixed within the support arm such that the abutment face and the support arm maintain contact therebetween.

14. The trash bag retaining system of claim 8, wherein the one or more surfaces defining the inlet comprises the slide stop.

15. The trash bag retaining system of claim 8, wherein the inlet is sized and shaped to release a portion of a trash bag in response to a lateral force parallel to the proximal end.

16. A trash bag retaining apparatus comprising:

a support arm including a sliding surface that extends between a first portion and a second portion of the support arm having uniform dimensions, the first portion configured to secure the support arm to a receptacle wall, and the second portion comprising:

a slide stop; and one or more surfaces defining a break in the sliding surface to form an inlet positioned adjacent to the slide stop, at least a portion of the sliding surface overhanging the inlet, wherein the inlet is configured to receive and selectively retain an edge of a trash bag;

wherein the inlet is sufficiently shallow such that a lateral pulling motion easily causes the edge of the trash bag to escape the inlet during removal of the trash bag from the trash bag retaining apparatus.

17. The trash bag retaining apparatus of claim 16, wherein the portion of the sliding surface overhanging the inlet comprises a portion of the sliding surface angled into the inlet.

18. The trash bag retaining apparatus of claim 16, wherein the inlet is sized and shaped to release a portion of a trash bag in response to a lateral force parallel to the support arm.

19. The trash bag retaining apparatus of claim 16, wherein:

the sliding surface is configured to interface with a portion of a trash bag; and the inlet is configured to receive the portion of the trash bag sliding into the inlet from the sliding surface.

20. The trash bag retaining system of claim 8, wherein each of the support arms is configured as a shaft of uniform dimensions without protrusions or recesses to facilitate lateral sliding of a trash bag across the support arm without requiring lifting of the trash bag.

* * * * *